United States Patent [19]

Echols et al.

[11] 4,179,991

[45] Dec. 25, 1979

[54] PERFORATING GUN BARREL

[75] Inventors: Robert B. Echols; William J. Berry, both of Pampa, Tex.

[73] Assignee: Titan Specialties, Inc., Pampa, Tex.

[21] Appl. No.: 910,007

[22] Filed: May 26, 1978

[51] Int. Cl.[2] ..... E21B 43/11; E21B 43/116

[52] U.S. Cl. ..... 102/21.6; 175/4.6; 285/332.3; 285/370; 285/404

[58] Field of Search ..... 166/55.1; 175/4.55, 175/4.6; 102/20, 21.6; 285/370, 397, 404, 332.3

[56] References Cited

U.S. PATENT DOCUMENTS

| | | | |
|---|---|---|---|
| 51,910 | 1/1866 | Barbaroux | 285/404 |
| 260,874 | 7/1882 | Jones et al. | 285/370 X |
| 1,188,485 | 6/1916 | Pruyn | 285/397 X |
| 2,775,471 | 12/1956 | Douglass | 285/332.3 |
| 3,173,992 | 3/1965 | Boop | 102/20 X |
| 3,208,378 | 9/1965 | Boop | 102/21.6 X |
| 3,528,511 | 9/1970 | Boop et al. | 166/55.1 X |
| 3,768,408 | 10/1973 | Hallmark | 175/4.55 X |

*Primary Examiner*—David H. Brown

*Attorney, Agent, or Firm*—Richards, Harris & Medlock

[57] ABSTRACT

A perforating gun barrel for carrying a plurality of explosive charges in a spaced apart relationship comprises a plurality of tubular sections positioned with the ends of adjacent tubular sections end-to-end, with the end of one section overlapping the end of an adjacent section. A coupling member is disposed entirely internally of said tubular sections at each coupling location. A plurality of bolts extend through the overlapping ends of the adjacent tubular sections and are secured in the coupling member to prevent separation of the adjacent tubular sections at the coupling locations. Wiring for detonating the charge carried in each tubular section is routed through a passageway provided in the coupling member.

9 Claims, 2 Drawing Figures

PERFORATING GUN BARREL

BACKGROUND OF THE INVENTION

This invention relates to guns for perforating oil well casing, and more particularly, it relates to the barrel portion of a perforating gun and the manner in which the sections of the gun barrel are interconnected in an end-to-end arrangement.

In a perforating gun, explosive charges are employed in an elongated barrel, with the charges being directed radially outward therefrom. The elongated barrel is formed by a plurality of tubular sections that are interconnected in an end-to-end arrangement. One manner of interconnecting the tubular sections to form the gun barrel is that of using threaded connections to interconnect the ends of adjacent tubular sections. Another manner of coupling adjacent tubular sections together to form an elongated barrel involves the use of a coupling section between adjacent tubular sections. See, for example, U.S. Pat. No. 3,528,511 to Boop et al.

Coupling sections utilized to interconnect adjacent tubular sections in a perforating gun barrel, such as that shown in Boop, have been cylindrically shaped members having a midsection that is of an outside diameter equal to the outside diameter of the tubular gun barrel sections. On each side of the midsection portion, the member is cylindrically shaped with an outside diameter that is equal to the inside diameter of the tubular gun barrel sections, such that the coupling section ends are insertable into the open ends of adjacent barrel sections. A number of bolts, typically four, are used to secure the end of a tubular section to an end of the coupling section.

This conventional bolt-together manner of interconnecting tubular sections to form a perforating gun barrel presents a number of attendant undesirable features. For example, the use of a coupling section that spaces apart the ends of adjacent tubular sections produces a wider spacing of the explosive charges at the coupling section locations resulting in a nonuniformity of perforation of a casing. Accordingly, fewer charges per unit of length of the gun barrel can be accommodated and a larger and heavier perforating gun is thus required to produce a given extent of perforation. Another attendant disadvantage to the described manner of coupling gun barrel sections together is that the stress of an explosion is borne almost exclusively by the coupling section between the adjacent barrel sections. The absorption of a substantial amount of the explosion-induced stress is by the connecting bolts and midsection portion of the coupling section, which can be deformed as a result and make the disassembling of the gun barrel for reloading difficult and the useful life of the coupling section relatively short.

Accordingly, it would be desirable to provide a means of interconnecting tubular sections to form an elongated perforating gun barrel that would permit the explosive charges to be uniformly distributed along the entire length of the barrel without gaps and which would distribute the stress of an explosion to the tubular sections, therefore providing a more efficient and economical perforating gun.

SUMMARY OF THE INVENTION

In accordance with the present invention, a perforating gun barrel comprises a plurality of tubular sections arranged in end-to-end alignment with the ends of adjacent tubular sections overlapping. A coupling member is disposed internally of the overlapping ends of each pair of adjacent tubular sections, with means being secured to the coupling member for preventing separation of the adjacent tubular sections at the coupling locations defined by the overlapping ends of the adjacent pairs of tubular barrel sections.

The overlapping relationship of the ends of adjacent tubular sections is accomplished by providing each tubular section with a lengthwise portion that extends a predetermined distance from one end of the section, which portion is of a reduced outside diameter from the remainder of the section, and a lengthwise portion extending a predetermined distance from the other end of the section, which is of an increased inside diameter. Accordingly, overlapping of the ends of adjacent tubular sections involves the insertion of the reduced outside diameter portion at one end of a tubular section into the open end of the adjacent tubular section that is of an increased inside diameter.

The reduced outside diameter portion and the increased inside diameter portion are preferably of different length to define an internal groove in the interior surface of interconnected adjacent tubular sections. The ends of each tubular section further include a plurality of circumferentially spaced openings therein which are registrable upon the insertion of one end into an adjacent end to form the overlapping relation.

The coupling member at each coupling location includes a ring formed on the outer periphery that is disposed in the internal groove formed between portions of the opposing faces of the overlapping ends of the adjacent tubular sections. The coupling member also includes a central passage therethrough to facilitate routing of the detonator wires between the explosive charges carried in the barrel. First and second sealing means are disposed at opposite ends of the coupling member and on opposite sides of the overlapping tubular section ends.

The means for preventing separation of adjacent tubular sections interconnected at the coupling locations preferably comprises a plurality of mutually perpendicular bolts extending through the openings in the overlapping portions of the ends of adjacent tubular sections. The bolts are held by threaded engagement in the coupling member.

Accordingly, in accordance with the present invention, a perforating gun barrel comprising a plurality of interconnected tubular sections is provided that permits a closer spacing of the explosive charges than has been heretofore obtainable using the prior art connection means. Further, a perforating gun barrel is provided that passes the stress of explosions directly from one tubular section to another, whereby the stress is not substantially borne by the coupling structure between the adjacent tubular sections.

DESCRIPTION OF THE DRAWINGS

For a more complete understanding of the present invention, reference may be had to the following description taken in conjunction with the accompanying drawings, wherein.

DETAILED DESCRIPTION OF THE INVENTION

Figure 1:
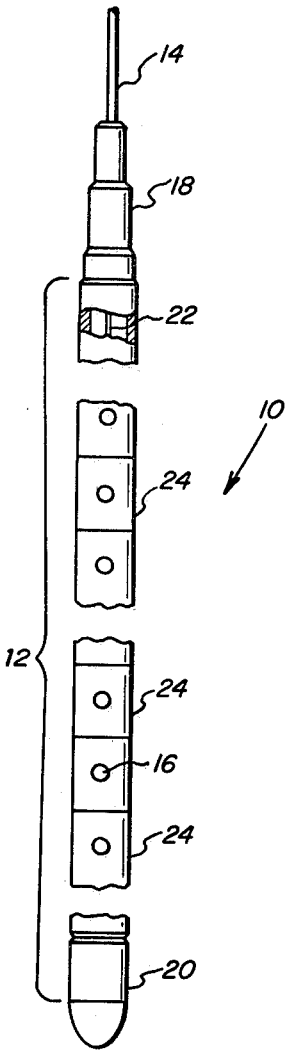
FIG. 1 is a side view of a perforating gun having an elongated barrel in accordance with the present invention.

Referring first to FIG. 1, a perforating gun 10 having a gun barrel 12 in accordance with the present invention is suspended for lowering into a well bore by a cable 14. The perforating gun 10 includes a plurality of shaped explosive charges 16 that are carried in ports formed in the wall of the perforating gun barrel 12. A cable adapter head 18 is at the upper end of gun 10 and a closure member 20 is at the lower end. An elongated fuse or detonator wiring 22 extends through the perforating gun barrel 12 and is in contact with each of the explosive charges to sequentially set off the charges.

Perforating gun barrel 12 comprises a plurality of the tubular sections 24 arranged end-to-end and secured together by coupling means to provide a rigid structure and facilitate the assembly and disassembly of the structure for replacement of spent explosive charges.

Figure 2:
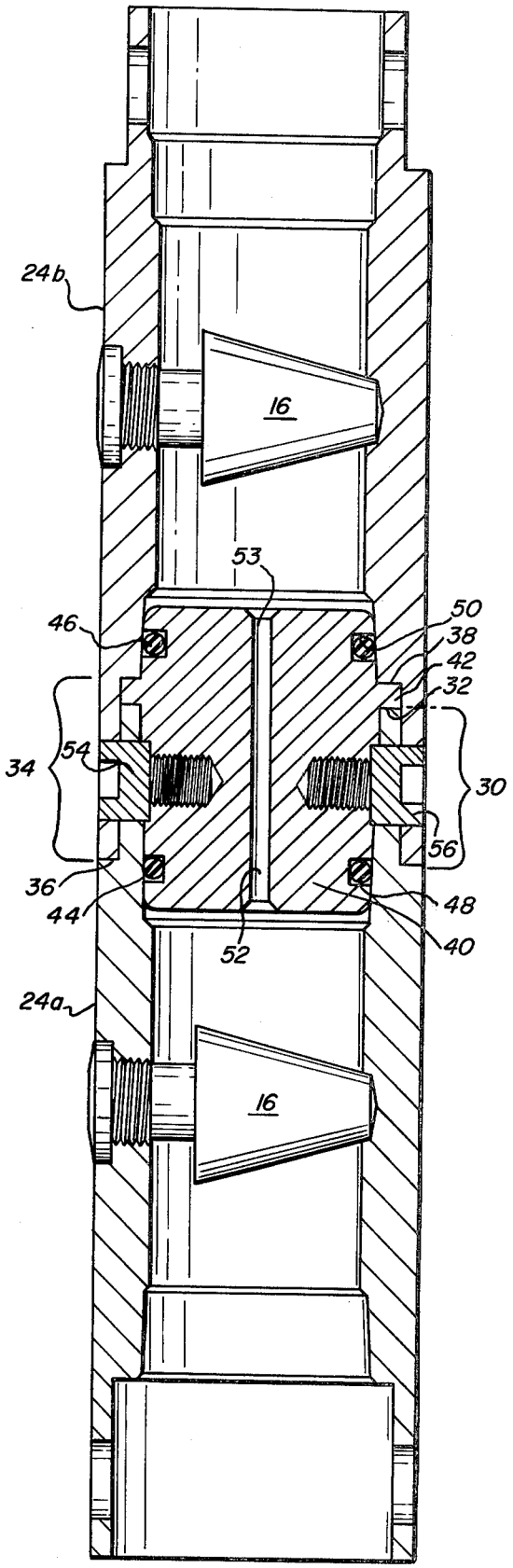
FIG. 2 is a section view of two interconnected tubular sections of the perforating gun barrel shown in FIG. 1.

In FIG. 2, the sectional view illustrates the manner in which the plurality of tubular sections 24 are interconnected to form perforating gun barrel 12. As shown in FIG. 2, the ends of adjacent tubular sections **24*a* and 24*b* overlap at the coupling locations. To provide for overlapping of the ends of adjacent tubular sections that form barrel 12, one end of each tubular section has a lengthwise portion 30, shown on section 24*a*, extending a predetermined distance from the face 32 of the one end, which portion is of a reduced outside diameter from the remainder of the tubular section. At the opposite end of each tubular section there is a lengthwise portion 34, shown on section 24*b*, extending a predetermined distance from the face 36, that is of an increased inside diameter. Accordingly, insertion of the reduced outside diameter end portion of one tubular section into the increased inside diameter end portion of an adjacent tubular section is permitted. The mating ends of adjacent tubular members formed in the aforementioned manner, though overlapping, provide a uniform outside diameter over the entire length of barrel 12**.

The coupling arrangement of the present invention, in addition to the employment of overlapping ends, utilizes a coupling member 40 at each coupling location, which is carried entirely internally of the coupled tubular sections. In the preferred embodiment illustrated in FIG. 2, coupling member 40 has a ring 42 formed on the outer periphery thereof that is interlocked between the opposing face portions 32 and 38 of the overlapping ends of adjacent tubular sections **24*a* and 24*b*. It will, of course, be appreciated that the length of the reduced outside diameter portion 30 of section 24*a* and the portion 34 of increased inside diameter of tubular section 24*b* must be of different lengths in order to define an internal groove for accommodating ring 42**.

Coupling member 40 further comprises a first sealing means, such as O-ring 44, and a second sealing means, such as O-ring 46, each of which is disposed at one end of coupling member 40 and on opposite sides of the overlapping ends of the adjacent tubular sections. O-rings 44 and 46 are carried in grooves 48 and 50, respectively, formed in coupling member 40. To assist in sealing around coupling member 40, the internal portions of the tubular section ends are tapered inwardly to mate with ends of the coupling member where ends are slightly tapered.

A passage 52 is provided in coupling member 40 to permit routing of the fuse or detonator wires between explosive charges. At one end of passageway 52, an internally threaded portion 53 is provided into which a pressure seal may be secured to seal around the fuse or detonator wires that extend through the passage.

Means for preventing separation of the adjacent tubular sections at the coupling locations is provided in the form of a plurality of bolts that extend through openings in the overlapping end portions of adjacent tubular sections and are secured by threads in coupling member 40. Although only bolts 54 and 56 are shown in FIG. 2, it is to be appreciated that two additional bolts are utilized. The two additional bolts would, of course, be disposed at right angles to bolts 54 and 56. Accordingly, separation of adjacent tubular sections **24*a* and 24*b* through relative movement that would remove end portion 30 of section 24*a* from its inserted location within end portion 34 of tubular section 24*b*** is prevented by the heads of the bolts disposed within the openings in the overlapping end portions.

With the overlapping end arrangement of the coupling technique of the present invention, it will be appreciated that axial stresses within the perforating gun barrel will be transmitted between the tubular sections in substantial measure, such that the bolts that prevent separation of the tubular sections at the coupling locations will not be called upon to absorb an excessive amount of stress. Further, a close and uniform spacing of the explosive charges carried by the gun barrel is provided.

The foregoing description of the invention has been directed to a particular preferred embodiment for purposes of explanation and illustration. It will be apparent, however, to those skilled in this art that modifications and changes in the illustrated embodiment may be made without departing from the scope and spirit of the invention. Accordingly, the following claims are intended to cover not only the embodiment illustrated herein but all equivalent modifications and variations as fall within the scope of the invention.

What is claimed is:

1. An elongated perforating gun barrel comprising:

(a) a plurality of tubular sections, each adapted to carry an explosive charge, where adjacent tubular sections are positioned end-to-end with the end of one section overlapping the end of an adjacent section to define a coupling location;

(b) a cylindrical coupling member at each coupling location disposed entirely internally of the interconnected adjacent tubular sections; and (c) means for securing one said coupling member to the adjacent tubular sections at a plurality of points at each coupling location for preventing separation of said tubular sections.

2. A perforating gun barrel in accordance with claim 1, wherein each tubular section has one end of a reduced outside diameter and the opposite end of an increased inside diameter such that the ends of adjacent tubular sections can be placed in an overlapping relation by the insertion of the reduced outside diameter end of a tubular section into the increased inside diameter end of an adjacent tubular section.

3. A perforating gun barrel in accordance with claim 1, wherein each tubular section has a lengthwise portion of a reduced outside diameter extending a predetermined distance from one end face and a lengthwise portion of an increased inside diameter extending a predetermined distance from the opposite end face such that the ends of adjacent tubular sections can be placed in an overlapping relation by the insertion of the portion of reduced outside diameter at the end of a tubular section into the portion of increased inside diameter at the end of an adjacent tubular section, with at least a portion of the end faces of said adjacent sections abutting.

4. A perforating gun barrel in accordance with claim 1, wherein said coupling member has seal means at each end extending around the periphery thereof, each in sealing engagement with the interior surface of one of the adjacent tubular sections, and has a centralized passageway therethrough for the routing of detonator wiring between the explosive charges in the adjacent, interconnected tubular sections.

5. A perforating gun barrel in accordance with claim 1, wherein each of the overlapping ends of adjacent, interconnected tubular sections has a plurality of circumferentially spaced openings therein, the openings being placed in registration upon insertion of the one end into the other end, and wherein said separation preventing means comprises a plurality of bolts extending through the registered openings with the head being counter sunk therein and each bolt being secured by threaded engagement in said coupling member.

6. A perforating gun barrel in accordance with claim 1, wherein each tubular section has a lengthwise portion of a reduced outside diameter extending a predetermined distance from one end face and a lengthwise portion of an increased inside diameter extending a predetermined distance from the opposite end face such that the ends of adjacent tubular sections can be placed in an overlapping relation by the insertion of the portion of reduced outside diameter at the end of a tubular section into the portion of increased inside diameter at the end of an adjacent tubular section, the reduced outside diameter portion and the increased inside diameter portion being of different lengths to define an internal groove at each coupling location; and wherein said coupling member has an outwardly projecting extension formed on the periphery thereof to be disposed within the internal groove.

7. A perforating gun in accordance with claim 1, wherein each end of said coupling member is tapered and disposed within the internal bore of one of the adjacent tubular sections and wherein said one of said adjacent tubular sections has a region thereof that is inwardly tapered to receive the tapered end of said coupling member.

8. An elongated perforating gun barrel of a uniform cross-section, comprising:

(a) a plurality of tubular sections interconnected end-to-end at defined coupling locations; each tubular section carrying an explosive charge and each tubular section having a portion extending a predetermined distance from one end of a reduced outside diameter and a portion extending a predetermined distance from the opposite end of an increased inside diameter, such that the ends of adjacent tubular sections overlap with the reduced outside diameter portion of a tubular section being inserted into the increased inside diameter portion of an adjacent tubular section, the reduced outside diameter portion and the increased inside diameter portion being of different lengths to define an internal groove in the interior surface of the interconnected adjacent tubular sections, and the ends of each tubular section having a plurality of circumferentially spaced openings therein, with the openings in the reduced outside diameter end portion of one tubular section and the openings in the increased inside diameter portion of an adjacent tubular section being registrable upon insertion of the one end into the other;

(b) a coupling member at each coupling location disposed entirely internally of adjacent, interconnected tubular sections, said coupling member having an outwardly extending ring formed on the periphery thereof to be positioned within the internal groove formed by the opposing end face portions of adjacent tubular sections, a central passageway therethrough for the routing of detonator wiring between the explosive charges in adjacent tubular sections, and seal means on opposite ends; and (c) a plurality of mutually perpendicular bolts extending through the openings in the overlapping portions of the ends of adjacent tubular sections and held by threaded engagement in said coupling member, the head portion of each bolt being counter sunk to lie beneath the outer surface of the tubular section having the end portion of increased inside diameter, said bolts preventing separation of adjacent, interconnected tubular sections at the coupling locations.

9. In a perforating gun barrel where two tubular sections are adapted to carry explosive charges with one section positioned end-to-end with the other section in overlapping relation to define a coupling location; the combination comprising:

(a) a generally cylindrical coupling member at said coupling location disposed entirely internally of said tubular sections and having opposite ends slightly tapered with outwardly facing grooves, at least one at each end, to receive O-rings for establishing a pressure seal at each end of said coupling member and having a circumferential shoulder intermediate said grooves and (b) at least one fastening means common to both said sections and said coupling member.

* * * * *